US007776801B2

(12) United States Patent
Täubert et al.

(10) Patent No.: US 7,776,801 B2
(45) **Date of Patent: *Aug. 17, 2010**

(54) ADDITIVE MIXTURE AS COMPONENT OF A MINERAL OIL COMPOSITION

(75) Inventors: Hiltrud Täubert, Leissling (DE); Wolfgang Haubold, Merseburg (DE); Erhard Brauer, Schkopau (DE); Torsten Meyer, Chemnitz (DE); Dietrich von der Wense, Golmsdorf (DE)

(73) Assignee: Leuna Polymer GmbH (DE)

( * ) Notice: Subject to any disclaimer, the term of this patent is extended or adjusted under 35 U.S.C. 154(b) by 715 days.

This patent is subject to a terminal disclaimer.

(21) Appl. No.: 10/577,006

(22) PCT Filed: Oct. 15, 2004

(86) PCT No.: PCT/DE2004/002314

§ 371 (c)(1),
(2), (4) Date: Mar. 27, 2007

(87) PCT Pub. No.: WO2005/040315

PCT Pub. Date: May 6, 2005

(65) Prior Publication Data

US 2007/0219100 A1 Sep. 20, 2007

(30) Foreign Application Priority Data

Oct. 22, 2003 (DE) ..... 103 49 864
Oct. 22, 2003 (DE) ..... 103 49 865

(51) Int. Cl.
*C10M 145/14* (2006.01)
*C10M 129/74* (2006.01)
*C10L 1/196* (2006.01)

(52) U.S. Cl. ..... 508/472; 508/485; 508/507; 44/393; 44/403

(58) Field of Classification Search ..... 508/459, 508/472; 44/393
See application file for complete search history.

(56) References Cited

U.S. PATENT DOCUMENTS

| | | | | | |
|---|---|---|---|---|---|
| 2,922,768 | A * | 1/1960 | Guido Mino et al. | ..... | 525/246 |
| 3,584,078 | A * | 6/1971 | Pilate et al. | ..... | 525/308 |
| 5,998,530 | A * | 12/1999 | Krull et al. | ..... | 524/474 |
| 6,495,495 | B1 * | 12/2002 | Alger et al. | ..... | 508/475 |
| 7,323,019 | B2 * | 1/2008 | Krull et al. | ..... | 44/389 |
| 7,377,949 | B2 * | 5/2008 | Krull et al. | ..... | 44/388 |
| 2007/0130821 | A1 * | 6/2007 | Taubert et al. | ..... | 44/393 |

FOREIGN PATENT DOCUMENTS

| | | | |
|---|---|---|---|
| EP | A-1 088 880 | | 4/2001 |
| JP | A-59 053593 | | 3/1984 |
| WO | WO03042336 | * | 5/2003 |
| WO | WO03042338 A2 | * | 5/2003 |

OTHER PUBLICATIONS

Patent Abstracts of Japan, vol. 008, No. 150 (C-233), Jul. 12, 1984.

* cited by examiner

*Primary Examiner*—Ellen M McAvoy
*Assistant Examiner*—Pamela Weiss
(74) *Attorney, Agent, or Firm*—Wood, Phillips, Katz, Clark & Mortimer

(57) ABSTRACT

An additive mixture as component of a composition of mineral oil as main component and trace portions of an additive mixture containing the additive components a) ethylene-vinylester copolymers modified by polar groups with molecular mass weight averages from 3000 to 50000 and an ethylene component of 50 to 90 mass %, and b) $C_2$-$C_6$-oxyalkyl-bridged $C_{12}$-$C_{40}$-monocarboxylic acids, and/or c) partially and/or completely imidated copolymers of unsaturated $C_4$-$C_{20}$-dicarboxylic acid anhydrides and vinyl aromatics and/or $C_2$-$C_{36}$-α-olefins, whereby the content of the additive mixture in the mineral is 0.005 to 1 mass %.

The compositions are suitable as flowable media to be transported at low temperatures and as mineral oil fuels with high lubricity and flowability.

6 Claims, No Drawings

ADDITIVE MIXTURE AS COMPONENT OF A MINERAL OIL COMPOSITION

This invention relates to an additive mixture as component of a composition of mineral oil as the main component and trace portions of an additive mixture as well as a method for producing a mineral oil composition that contains the additive mixture.

Formulations of mineral oil as the main component and trace portions of additive mixtures made of usual unmodified ethylene-vinylacetate copolymers, hydrocarbon polymers, esterified maleic anhydride-olefin copolymers, polar nitrogen compounds such as amine salts of multivalent carboxylic acids and esterified polyoxyalkylenes are known (WO 94/10 267 A1, WO 95/33 012 A1, EP 0 921 183 A1, WO 93/14 178 A1, EP 0 889 323 A1).

Disadvantages include insufficient flow properties and stability in storage of these formulations at low temperatures and limited lubricating ability of these formulations when the mineral oil component has a sulfur content below 0.005 mass %.

It is the object of this invention to provide an additive mixture as component for a formulation containing mineral oil as main component and trace portions of an additive mixture that has improved flow properties and stability in storage at low temperatures and improved lubricity. The improved flow behavior is to result in energy savings at the pump sets through which these formulations are transported. These additive mixtures are to be developed taking into account that mineral oils with a very low sulfur content are to be used to make fuels with improved environmental compatibility as regards pollutant emissions of vehicles.

The object of the invention was achieved by an additive mixture as component of a formulation of mineral oil as main component and trace portions of an additive mixture in which the additive mixture comprises the following additive components according to the invention:

a) ethylene-vinylester copolymers modified by polar groups with molecular mass weight averages from 3000 to 50000 and an ethylene content of 50 to 90 mass %, and b) $C_2$-$C_6$-oxyalkyl-bridged $C_{12}$-$C_{40}$-monocarboxylic acids, and/or c) partially and/or completely imidated copolymers of ethylenically unsaturated $C_4$-$C_{20}$-dicarboxylic acid anhydrides and vinyl aromatics and/or $C_2$-$C_{36}$-α-olefins, whereby the content of the additive mixture in the mineral oil is 0.005 to 1 mass % and the mass proportion of the additive components a/b or a/c or a/(b+c) is 10:90 to 90:10, respectively.

Examples of vinylester components that may be contained in the modified ethylene-vinylester copolymers are vinyl acetate, vinyl propionate, 2-ethylhexyl vinylester, vinyl laurate, 2-hydroxyethyl vinylester, and 4-hydroxybutyl vinylester.

The ethylene-vinylester copolymers may contain 1 to 30 mass %, in relation to the vinyl ester, of other unsaturated ester components such as (meth)acrylic esters like acrylic methyl ester, methyl methacrylate, ethyl methacrylate, butyl acrylate, 2-ethylhexyl acrylate, ethyleneglycol dimethacrylate, dodecyl acrylate or hydroxyethyl methacrylate and/or vinyl ethers such as octylvinyl ether or hexanediol monovinyl ether.

The ethylene-vinylester copolymers are modified by polar groups in that specific terminal groups such as aldehyde terminal groups, preferably terminal groups from acetaldehyde, propionaldehyde, butyraldehyde, or isobutyraldehyde, carboxyalkylmercapto terminal groups, preferably terminal groups from mercaptoacetic acid or mercaptopropionic acid, or alkoxy terminal groups are incorporated into the copolymer, in that hydroxy and/or carboxy groups are incorporated into the copolymer by partial oxidation or saponification, by reacting the ethylene-vinylester-vinylalcohol copolymers with aldehydes to form hemiacetals, or by grafting polar, ethylenically unsaturated monomers onto the copolymer.

The ethylene-vinylester copolymers modified by polar groups and contained in the additive mixture preferably are oxidized ethylene-vinylacetate copolymers with molecular mass number averages of 800 to 5000, acid numbers from 2 to 40 mg KOH/g and OH numbers from 20 to 150 mg KOH/g, or partially saponified ethylene-vinylacetate copolymers with molecular mass number averages of 800 to 5000 in which 5 to 30 mol % of the vinylacetate units are saponified, or hemiacetals of ethylene-vinylester-vinylalcohol copolymers with butyraldehyde.

Examples of hemiacetals of ethylene-vinylester-vinylalcohol copolymers with butyraldehyde are hemiacetals of ethylene-vinylacetate-vinylalcohol copolymers that were reacted in a heterogenic phase with butyraldehyde as described in DD 295 507 A7.

Other preferred ethylene-vinylester copolymers modified by polar groups are ethylene-vinylester copolymers grafted with 6 to 20 mass % of polar unsaturated monomers of the vinyl ester, (meth)acryl ester and/or vinyl ether type.

These copolymers can be modified by grafting in that the unsaturated monomers are reacted in an extruder (DD 282 462 B5) or stirred tank reactor (DD 293 125 B5) in the presence of thermally decomposing radical formers. It is also possible to perform the modification during the production of the copolymer according to the high-pressure process by adding the monomer to the polymer melt in a low-pressure separator or in a discharging extruder.

Particularly preferred as modified ethylene-vinylester copolymers are ethylene-vinylacetate copolymers grafted with vinylacetate and having molecular mass number averages from 800 to 5000 and a total vinylacetate content of 20 to 60 mass %, the vinylacetate content of the copolymer backbone chain being from 10 to 40 mass % and the portion of the grafted vinylacetate branches making up 10 to 20 mass %.

The modified ethylene-vinylester copolymers may contain up to 35 mass % of poly-$C_6$-$C_{36}$-alkyl (meth)acrylate and/or unmodified ethylene-vinylester copolymers.

Examples of polyalcohols that are contained as alcohol component in the $C_2$-$C_6$-oxyalkyl-bridged $C_{12}$-$C_{40}$-monocarboxylic acids b) of the additive mixture are ethylene glycol, polyalkylene glycols, glycerine, 1,1,1-tris-(hydroxymethyl) propane, pentaerythrite, and sorbite.

Examples of $C_{12}$-$C_{40}$-monocarboxylic acids that are contained as carboxylic acid component in the $C_2$-$C_6$-oxyalkyl-bridged $C_{12}$-$C_{40}$-monocarboxylic acid b) of the additive mixture are laurinic acid, palmitic acid, stearic acid, oleic acid, elaidic acid, ricinoleic acid, eleostearic acid, linolic acid, linolenic acid, and erucic acid, or dimeric acids based on oleic acid or linolenic acid.

Also preferred as $C_2$-$C_6$-oxyalkyl-bridged $C_{12}$-$C_{40}$-monocarboxylic acids b) are mixed esters of polyalcohols in which the polyalcohols are esterified by mixtures of $C_{12}$-$C_{40}$-monocarboxylic acids. Special examples of $C_2$-$C_6$-oxyalkyl-bridged $C_{12}$-$C_{40}$-monocarboxylic acids are the monoester of ethylene glycol with dilinolenic acid, a $C_{36}$-dimeric acid, the diester of propylene glycol with oleic acid, and the triester of pentaerythrite with stearic acid.

Particularly preferred as $C_2$-$C_6$-oxyalkyl-bridged $C_{12}$-$C_{40}$-monocarboxylic acids b) are esters of unsaturated $C_{16}$-$C_{24}$-monocarboxylic acids with $C_3$-$C_4$-polyalcohols, the $C_{22}$-monocarboxylic acid content in relation to the overall mass of the $C_{16}$-$C_{24}$-monocarboxylic acids being 45 to 52 mass %.

Examples of unsaturated $C_{16}$-$C_{24}$-monocarboxylic acids that may be contained in the preferred esters of unsaturated $C_{16}$-$C_{24}$-monocarboxylic acids with $C_3$-$C_4$-polyalcohols as additive component b) are oleic acid, linolic acid, linolenic acid, and erucic acid.

Examples of ethylenically unsaturated $C_4$-$C_{20}$-dicarboxylic anhydrides that are present as monomeric components in the copolymers of ethylenically unsaturated $C_4$-$C_{20}$-dicarboxylic anhydrides and vinyl aromatics and/or $C_2$-$C_{36}$-α-olefins that are present partially and/or completely imidated as additive component c) in the additive mixture of the mineral oil formulations are allylsuccinic anhydride, bicycloheptene dicarboxylic anhydride, bicyclooctene dicarboxylic anhydride, carbomethoxymaleic anhydride, citraconic anhydride, cyclohexene dicarboxylic anhydride, dodecencyl succinic anhydride, glutaconic anhydride, itaconic anhydride, maleic anhydride, mesaconic anhydride, methylbicycloheptene dicarboxylic anhydride and/or methylcyclohexene dicarboxylic anhydride, maleic anhydride and/or itaconic anhydride being preferred.

Examples of vinyl aromatics suitable as comonomers that may be contained as monomeric components in the partially and/or completely imidated copolymers of ethylenically unsaturated $C_4$-$C_{20}$-dicarboxylic anhydrides c) of the additive mixtures are styrene, α-methylstyrene, and vinylpyridine.

Examples of $C_2$-$C_{36}$-α-olefins suitable as comonomers that may be contained as monomeric components in the partially and/or completely imidated copolymers of ethylenically unsaturated $C_4$-$C_{20}$-dicarboxylic anhydrides c) of the additive mixture are ethylenically unsaturated monomers such as $C_2$-$C_{20}$-olefins, $C_4$-$C_{21}$-acrylic esters, $C_5$-$C_{22}$-methacrylic esters, $C_5$-$C_{14}$-vinylsilanes, $C_6$-$C_{15}$-acrylate silanes, acrylic acid, methacrylic acid, acrylnitrile, vinyl oxazoline, isopropenyl oxazoline, vinyl pyrrolidone, amino-$C_1$-$C_8$-alkyl-(meth) acrylate, $C_3$-$C_{20}$-vinylester, $C_3$-$C_{20}$-vinylether and/or hydroxy-C1-$C_8$-alkyl-(meth)acrylate.

Preferred comonomers as monomeric components in the partially and/or completely imidated copolymers of ethylenically unsaturated $C_4$-$C_{20}$-dicarboxylic anhydrides c) of the additive mixtures are isobutylene, di-isobutylene, vinylacetate, styrene, and α-methylstyrene.

It is preferred that the partially imidated copolymers of $C_4$-$C_{20}$-ethylenically unsaturated acid anhydrides and vinyl aromatics and/or $C_2$-$C_{36}$-α-olefins as additive components c) have a mole ratio from 1:1 to 1:9 and molecular mass weight averages from 5000 to 500000, that they have been partially imidated with ammonia, $C_1$-$C_{24}$-monoalkylamines, $C_6$-$C_{18}$-aromatic monoamines, $C_2$-$C_{18}$-monoaminoalcohols, monoaminated poly ($C_2$-$C_4$-alkylene)-oxides with a molar mass of 400 to 3000, and/or monoetherified poly($C_2$-$C_4$-alkylene) oxides with a molar mass of 100 to 10000, the mole ratio of anhydride groups copolymer/ammonia, amino group $C_1$-$C_{24}$-monoalkylamines, $C_6$-$C_{18}$-aromatische monoamines, $C_2$-$C_{18}$-monoaminoalcohols or monoaminated poly-($C_2$-$C_4$-alkylene) oxide and/or hydroxy groups poly-($C_2$-$C_4$-alkylene)oxide is 1:1 to 20:1.

Particularly suited as partially or completely imidated copolymers from ethylenically unsaturated $C_4$-$C_{20}$-dicarboxylic anhydrides c) are maleic anhydride copolymers imidated with $C_{12}$-$C_{24}$-monoalkyl amines such as oleylamine, dodecylamine, hexadecylamine, octadecylamine, or eicosylamine, monosubstituted diamines such as N-dodecyl-1,3-diaminopropane, N-octadecyl-1,3-diaminopropane, or N-octadecyl propylene triamine, or aminoalcohols such as aminodecane-10-ol or aminohexadecane-16-ol.

Particularly preferred partially imidated copolymers of dicarboxylic anhydrides and vinyl aromatics and/or $C_2$-$C_{36}$-α-olefins as additive component c) are maleic anhydride-α-methylstyrene copolymers partially imidated with $C_6$-$C_{24}$ monoalkylamines in which the mole ratio of anhydride groups in the copolymer to bound $C_6$-$C_{24}$-monoalkylamine in the copolymer is 8:1 to 1.3:1.

Examples of mineral oils that form the main component in the formulations of mineral oil and trace portions of an additive mixture are crude oils and petroleum distillates with a distillation range from 100 to 500° C. such as lubricating oils, kerosine, diesel oil, heating oil, heavy fuel oils, petroleum, tractor fuel, and cracked gasoline. The mineral oils may also contain up to 30 mass % of synthesized hydrocarbons from the Fischer-Tropsch process, up to 20 mass % of modified vegetable oils based on sunflower oil, soybean oil, rape-seed oil, or animal oils, biodiesel and/or up to 10 mass % of alcohols such as methanol or ethanol.

Preferred are the mineral oils in the formulations of mineral oils and trace portions of an additive mixture, crude oils, or fuel oils from a middle distillate with a sulfur content of under 0.05 mass %, particularly fuel oils, gas oils, or diesel oils.

The preferred content of the additive mixture in the mineral oil is between 0.01 and 0.3 mass %.

In addition, the mineral oil may contain a total of 0 to 200 mass % in relation to the total of additive components a) and b) or a) and c) or a), b), and c), of other additive components such as fatty acid mixtures, polar nitrogen compounds, preferably polyamines, etheramines, amino alcohols, amine salts, amides or imides of multivalent carboxylic acids; $C_7$-$C_{30}$-alcohols, polyalkylene glycols, esters or ethers of polyoxyalkylene compounds, unmodified ethylene-vinylester copolymers, hydrocarbon polymers, alkylphenol-aldehyde copolymers, aromatic compounds with $C_8$-$C_{100}$-alkyl substituents, carboxylated polyamines, detergents, corrosion inhibitors, demulsifiers, metal deactivators, cetane number improvers, defoaming agents and/or cosolvents.

Examples of the fatty acid mixtures contained as other additive components in the mineral oil are mixtures of saturated and/or unsaturated $C_6$-$C_{40}$-carboxylic acids such as lauric acid, palmitic acid, oleic acid, linolenic acid, dimeric fatty acids, and alkenyl succinic acids.

Examples of the polar nitrogen compounds of the polyamine type contained as other additive components in the mineral oil are N-hexadecyl-1,3-diaminopropane, N-octadecyl dipropylenetriamine, N-dodecyl-1,3-diaminopropane, N,N'-didodecyl-1,3-diaminopropane, and N,N'-dioctadecyl dipropylenetriamine.

Examples of polar nitrogen compounds of the etheramine type contained as other additive components in the mineral oil are 3-methoxypropylamine, 3-N-octyloxypropyl-1,3-diaminopropane, and 3-N-(2,4,6-trimethyldecyloxypropyl)-1,3-diaminopropane.

Examples of polar nitrogen compounds of the amino alcohol type contained as other additive components in the mineral oil are aminopentane-5-ol, aminoundecane-11-ol, and 2-amino-2-methylpropanol.

Examples of amines contained as other additive components on which polar nitrogen compounds of the amine salt, amide, or imide type of multivalent carboxylic acids are based are $C_8$-$C_{40}$-amines such as hydrated tallamine, tetradecylamine, eicosylamine, dioctadecylamine, methyl behenylamine, N-oleyl-1,3-diaminopropane, N-stearyl-1-methyl-1,3-diaminopropane, or N-oleyldipropylenetriamine.

Examples of the multivalent carboxylic acids as other additive components on which polar nitrogen compounds of the amine salt or amide type of multivalent carboxylic acids are based are phthalic acid, isophthalic acid, terephthalic acid, naphthaline dicarboxylic acid, ethylene diamine tetraacetic acid, and cyclohexane dicarboxylic acid.

Special examples of the polar nitrogen compounds of the amine salt type contained as other additive components in the mineral oil are N-methyl triethanol ammonium distearyl ester chloride and N-methyl triethanol ammonium distearyl ester methosulfate.

Examples of $C_7$-$C_{30}$-alcohols that may be contained as other additive components in the mineral oil are dodecanol, stearyl alcohol, and ceryl alcohol.

Examples of polyalkylene glycols that may be contained as other additive components in the mineral oil are polyethylene glycols, polypropylene glycols, and ethylene oxide-propylene oxide copolymers with molar masses from 500 to 5000.

Examples of esters of polyoxyalkylene compounds that may be contained as other additive components in the mineral oil are $C_{10}$-$C_{24}$-monoalkyl esters or dialkyl esters of polyalkylene glycols such as polyethylene glycol monostearyl ester or polypropylene glycol dioleate.

Examples of ethers of polyoxyalkylene compounds that may be contained as other additive components in the mineral oil are $C_1$-$C_4$-monoalkyl ethers or dialkyl ethers of polyalkylene glycols such as polyethylene glycol monostearyl ether or polypropylene glycol dibutyl ether.

Examples of hydrocarbon polymers that may be contained as other additive components in the mineral oil are copolymers of ethylene and $C_3$-$C_{20}$-$\alpha$-olefins such as ethylene-propylene copolymers or ethylene-dodecene copolymers or hydrated polymers of multiply unsaturated monomers of the hydrated diene copolymer type such as hydrated polybutadiene or hydrated polyisoprene with molecular mass number averages up to 30000.

Examples of alkyl phenol-aldehyde copolymers that may be contained as other additive components in the mineral oil are copolymers that can be produced by reacting alkylated phenols such as phenol propylene oligomer adducts with paraformaldehyde.

Examples of aromatic compounds with $C_8$-$C_{100}$-alkyl substituents that may be contained as other additive components in the mineral oil are compounds that can be produced by means of Friedel-Krafts condensation of halogenated hydrocarbons such as halogenated polyethylene wax with aromatic hydrocarbons like benzene or naphthaline.

Examples of detergents that may be contained as other additive components in the mineral oil are aliphatic sulfonic acids such as $C_8$-$C_{30}$-alkane sulfonates or aromatic-aliphatic alkane sulfonates, especially nonylbenzene sulfonic acid, dodecylbenzene sulfonic acid, didodecylbenzene sulfonic acid, and nonylnaphthaline sulfonic acid.

Examples of demulsifiers that may be contained as other additive components in the mineral oil are oxalkylated phenol-formaldehyde condensates, polyalkylene glycol-modified diglycid ethers, polyesteramines, or alkoxylated fatty acids.

Examples of cetane number improvers that may be contained as other additive components in the mineral oil are organic nitric esters such as ethylhexyl nitrate, cyclohexyl nitrate, or ethoxyethyl nitrate, or soluble organic peroxides, hydroperoxides, or peresters.

Preferred defoaming agents that may be contained as other additive components in the mineral oil are polyalkylene oxide-siloxane block copolymers and carboxylated polyamines.

Examples of polyalkylene oxide-siloxane block copolymers are block copolymers that contain a combination of trifunctional siloxane blocks such as monomethyl siloxane groups, difunctional siloxane groups such as dimethyl siloxane groups, and monofunctional siloxane groups such as trimethyl siloxane groups; a preferred length of the siloxane blocks is from 5 to 20 monomeric units. The preferred length for the polyalkylene oxide blocks is 2 to 40 monomeric units, preferred are polyoxyalkylene blocks of ethylene oxide and/or propylene oxide units.

Examples of carboxylated polyamines as defoaming agents are reaction products of $C_8$-$C_{24}$-fatty acids and amines such as ethylene diamine, butylene diamine, diethylene triamine, and pentaethylene hexamine-1,2-diaminobutanol.

Examples of cosolvents that may be contained as other additive components in the mineral oil compositions are gasoline fractions, toluene, xylene, ethyl benzene, isononanol, ethyl hexanol, dodecyl phenol, epoxidized rapeseed oil, and epoxidized soybean oil.

The formulations of mineral oil as the main component and trace portions of an additive mixture are produced using a method in which, according to the invention, mineral oil formulations that contain the additive components a) ethylene-vinylester copolymers modified by polar groups with molecular mass weight averages from 3000 to 50000 and an ethylene content of 50 to 90 mass %, and b) $C_2$-$C_6$-oxyalkyl-bridged $C_{12}$-$C_{40}$-monocarboxylic acids, and/or c) partially and/or completely imidated copolymers of unsaturated $C_4$-$C_{20}$-dicarboxylic acid anhydrides and vinyl aromatics and/or $C_2$-$C_{36}$-$\alpha$-olefins, whereby the content of the additive mixture in the mineral oil is 0.005 to 1 mass % and the mass proportion of the additive components a/b or a/c or a/(b+c) is 10:90 to 90:10, respectively, are produced in a prehomogenization process in which solutions containing 1 to 60 mass % of additive components in mineral oil middle distillates are produced at 20 to 90° C. in a first process step, and the solutions containing the additive components are homogenized with the mineral oil as the main component in a second process step, whereby a total of 0 to 200 mass % in relation to the total of additive components a) and b) or a) and c) or a), b) and c) of other additive components are added to the mineral oil in the first and/or second process step.

The formulations according to the invention consisting of mineral oil as the main component and trace portions of an additive mixture are preferably suitable as flowable media to be transported at low temperatures and as mineral oil fuels with high lubricity and flowability.

Examples of the flowable media to be transported at low temperatures are the transport of crude oil formulations from the extraction site of the crude oil through pipelines to loading and storage and the transport of diesel or heating oil formulations in pipelines.

The invention is explained in greater detail by the examples below.

EXAMPLES

The characteristic numbers were determined in accordance with the following test methods:

Cloud point (CP): DIN EN 23 015

Cold filter plugging point (CFPP): EN 116

Distillation analysis: EN ISO 3405, ASTM D 86

IBP: Initial Boiling Point

FBP: Final Boiling Point

Vinyl acetate content: modified method according to ISO 8995, DIN 16778 Part 2:

2 g of sample are weighed in with 0.001 g precision and dissolved in a 300 ml Erlenmeyer flask with 70 ml distilled xylene and 2 boiling beads under refluxing for ca. 15 minutes. Then ca. 30 ml of ethanol are slowly added via the reflux cooler, the Erlenmeyer flask is taken off the heating plate, 30 ml of ethanol, 0.5 n KOH from the burette and 2 boiling beads are added, and the sample is refluxed for 1 hour. The sample is taken off the reflux again, mixed with 30 ml of methanolic-aqueous 0.5 n HCl and 2 boiling beads, and refluxed for another 15 minutes. After adding 2 to 3 drops of phenolphthaleine solution (1 mass % in ethanol), the sample is titrated drop by drop under shaking with ethanolic 0.5 n KOH until its color changes to red. A blank value has to be determined at the same time.

$$\text{Vinyl acetate content in mass } \% = \frac{(V - BV) \times F \times 43}{10 \times E}$$

E=original sample weight in g

F=factor of the ethanolic 0.5 n KOH

V=consumption in ml of 0.5 n ethanolic KOH for the sample

B=consumption in ml of 0.5 n ethanolic KOH for the blank value

Lubricating ability: Lubricity test (adjusted "wear scar diameter" at 60° C.) according to ISO 12156-1

Short-Time Sedimentation Test:

To test the sedimentation tendency of recrystallized paraffins in mineral oil, a 500 ml sample is stored in a graduated cylinder for 16 hours, then the top 80 volume percent of the sample are drawn off and discarded. The remaining 20 vol % of the sample (100 ml) are homogenized at 40° C., then the cloud point (CP) is determined according to DIN EN 23 015.

SEDAB Filtration Test:

A 500 ml mineral oil sample is shaken vertically 20 times, kept at 10° C. for 16 hours, shaken vertically 10 times, and the entire sample is filtered all at once through a filter of cellulose nitrate (50 mm in diameter, 0.8 μm pore size) that sits on a suction cap with a vacuum of approx. 200 hPa. The time in which the sample runs through the filter is measured. The SEDAB filtration test is deemed passed if the sample passes through the filter in a period<120 s.

Example 1

1.1 Starting Materials

1.1.1 Diesel without Additives

Batch: 16080601 test DF 1

Characterization:

Cloud point (CP): +6° C.;

Cold filter plugging point (CFPP): +2° C.

Lubricity test: 563 μm

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 189 | 243 | 259 | 271 | 281 | 292 | 303 | 317 | 334 | 357 | 385 |

1.1.2 Additive Component a)

60 mass % of an ethylene-vinylacetate copolymer wax grafted with vinyl acetate (produced according to DD 293 125 A5, total vinyl acetate content 45 mass %, molecular mass weight average 3800 g/mol, vinyl acetate content of the ungrafted ethylene-vinylacetate copolymer wax 32 mass %, degree of saponification 32 mol %) and 40 mass % of an ungrafted ethylene-vinylacetate copolymer wax (manufactured by LEUNA Polymer GmbH, vinylacetate content 32.5 mass %, molecular mass number average 1920 g/mol) are intermixed.

1.1.3 Additive Component b)

Mixture of $C_3$-oxyalkyl-bridged unsaturated $C_{18}$-$C_{24}$-carboxylic acids, degree of esterification 92 mol %, content of $C_{18}$-unsaturated fatty acids 32 mass %, content of $C_{22}$-unsaturated fatty acids 48 mass %, iodine number 96

1.1.4 Additive Component c)

Styrene-maleic anhydride copolymer, partially imidated with $C_{16}$-$C_{18}$-fatty amine, molecular mass number average 9500 g/mol, acid number 29

1.1.5 Other Additive Components

Didodecylamidobenzoate 1.2 Production of Solutions Containing the Additive Components in Mineral Oil Middle Distillates 25 kg of a 40% solution of additive component c) in $C_8$-$C_9$-diesel aromatic fraction, 50 kg of a 50% solution of additive component a) in an aromatic hydrocarbon mixture (Solvesso), and 25 kg of additive component b), and 1 kg of the other additive component, didodecyl amidobenzoate are intermixed in a stirred tank reactor for 90 minutes at 65° C., and the mixture is transferred into a storage tank.

1.3 Production of the Mineral Oil Composition

The additive solution according to 1.2 is injected at 0.48 kg/min into a product stream of diesel without additives, batch 16080601, flowing at 800 kg/min and the mixture is transferred into a storage tank.

Testing the mineral oil formulation for low-temperature resistance revealed a CFPP value of −10° C. The lubricity test shows a "wear scar diameter" of 395 μm.

If a mineral oil formulation that only contains the ungrafted copolymer wax as an additive is produced under the same conditions, the CFPP value is −3° C. and the "wear scar diameter" is 520 μm.

Example 2

2.1 Starting Materials 2.1.1 Diesel without Additives

Batch: 030210 DGO test DF 2

Characterization:

Cloud point (CP): +8° C.;

Cold filter plugging point (CFPP): +3° C.

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 235 | 266 | 279 | 291 | 301 | 310 | 320 | 337 | 342 | 357 | 374 |

Lubricity test: 556 μm 2.1.2 Additive Component a)

50 mass % of a partially saponified ethylene-vinylacetate copolymer wax (molecular mass weight average 1600 g/mol, vinylacetate content of the unsaponified ethylene-vinylacetate copolymer wax 29 mass %, degree of saponification 15 mol %) and 50 mass % of an unsaponified ethylene-vinylacetate copolymer wax (manufactured by LEUNA Polymer GmbH, vinylacetate content 29 mass %, molecular mass number average 2015 g/mol) are intermixed.

2.1.3 Additive Component b)

Triesters of Pentaerythrite with Stearic Acid 2.1.4 Additive Component c)

Styrene-maleic anhydride copolymer, partially imidated with $C_{16}$-$C_{18}$-fatty amine, molecular mass number average 21000 g/mol, acid number 37

2.1.5 Other Additive Components

Vinylacetate-ethylhexylacrylate copolymer (mole ratio 1.5:1, molecular mass number average 13500)

2.2 Production of Solutions Containing the Additive Components in Mineral Oil Middle Distillates 25 kg of a 40% solution of additive component c) in $C_8$-$C_9$-diesel aromatic fraction, 50 kg of a 60% solution of additive component a) in $C_8$-$C_9$-diesel aromatic fraction 25 kg of additive component b), and 20 kg of a 20% solution of another additive component, vinylacetate-ethylhexylacrylate copolymer in toluene, are intermixed in a stirred tank reactor for 90 minutes at 65° C., and the mixture is transferred into a storage tank.

2.3 Production of the Mineral Oil Composition

The additive solution according to 2.2 is injected at 0.12 kg/min into a product stream of diesel without additives, batch 030210, flowing at 800 kg/min and the mixture is transferred into a storage tank.

Testing the mineral oil formulation for low-temperature resistance revealed a CFPP value of −10° C. The lubricity test shows a "wear scar diameter" of 387 μm.

If a mineral oil formulation that only contains the unsaponified copolymer wax as an additive is produced under the same conditions, the CFPP value is −5° C. and the "wear scar diameter" is 528 μm.

Example 3

3.1 Starting Materials 3.1.1 Heating Oil without Additives

Batch: 030225 test HEL 1

Characterization:

Cloud point (CP): +1° C.;

Cold filter plugging point (CFPP): −1° C.

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 165 | 196 | 213 | 230 | 249 | 269 | 290 | 310 | 327 | 344 | 363 |

3.1.2 Additive Component a)

40 mass % of an oxidized ethylene-vinylacetate copolymer wax (molecular mass number average 950 g/mol, vinylacetate 29.5 mass %, acid number 18 mg KOH/g, OH number 70 mg KOH/g) and 60 mass % of an unoxidized ethylene-vinylacetate copolymer wax (manufactured by LEUNA Polymer GmbH, vinylacetate content 32.5 mass %, molecular mass weight average 4400 g/mol) are intermixed.

3.1.3 Additive Component b)

Diester of propylene glycol with oleic acid 3.1.4 Additive Component c)

Styrene-maleic anhydride copolymer, partially imidated with $C_{16}$-$C_{18}$-fatty amine, molecular mass number average 9500 g/mol, acid number 25

3.1.5 Other Additive Component 2-amino-2-methyldodecanol 3.2 Production of Solutions Containing the Additive Components in Mineral Oil Middle Distillates 25 kg of a 40% solution of additive component c) in $C_8$-$C_9$-diesel aromatic fraction, 10.0 kg of a 60% solution of additive component a) in $C_8$-$C_9$-diesel aromatic fraction 10 kg of additive component b), and 2.0 kg of another additive component, 2-amino-2-methyl-dodecanol, are intermixed in a stirred tank reactor for 90 minutes at 65° C., and the mixture is transferred into a storage tank.

3.3 Production of the Mineral Oil Composition

The additive solution according to 3.2 is injected at 0.24 kg/min into a product stream of heating oil without additives, batch 030225, flowing at 800 kg/min, and the mixture is transferred into a storage tank.

Testing the mineral oil formulation for low-temperature resistance revealed a CFPP value of −15° C.

If a mineral oil formulation containing only the unoxidized copolymer wax as an additive is produced under the same conditions, the CFPP value is −13° C.

Example 4

4.1 Starting Materials 4.1.1 Heating Oil without Additives

Batch 030218 Test HEL 2

Characterization:
Cloud point (CP): +2° C.;
Cold filter plugging point (CFPP): −1° C.
Distillation Analysis:
Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 173 | 194 | 207 | 225 | 247 | 273 | 299 | 320 | 337 | 355 | 379 |

4.1.2 Additive Component a)

40 mass % of an ethylene-vinylacetate copolymer wax grafted with vinyl acetate (produced according to DD 293 125 A5, total vinylacetate content 38 mass %, molecular mass weight average 6400 g/mol, vinylacetate content of the ungrafted ethylene-vinylacetate copolymer wax 32 mass %) and 60 mass % of an ungrafted ethylene-vinylacetate copolymer wax (manufactured by LEUNA Polymer GmbH, vinylacetate content 32 mass %, molecular mass weight average 4400 g/mol) are intermixed.

4.1.3 Additive Component b)

Mixture of $C_3$-oxyalkyl-bridged unsaturated $C_{18}$-$C_{24}$-carboxylic acids, degree of esterification 92 mol %, content of $C_{18}$-unsaturated fatty acids 32 mass %, content of $C_{22}$-unsaturated fatty acids 48 mass %, iodine number 96

4.1.4 Other Additive Components

Polyethylene glycol monomethyl ether, molecular mass number average 1500
3-laurylacrylate-ethylacrylate copolymer (mole ratio 3:1)

4.2 Production of Solutions Containing the Additive Components in Mineral Oil Middle Distillates 10 kg of a 40% solution of additive component b) in $C_8$-$C_9$-diesel aromatic fraction, 1.0 kg of polyethyleneglycol monomethyl ether, and 6.2 kg of a 20% solution of another additive component, laurylacrylate-ethylacrylate copolymer in toluene are introduced into a stirred tank reactor containing 20 kg of a 60% solution of additive component a) in $C_8$-$C_9$-diesel aromatic fraction, stirred for 90 minutes, and the mixture is transferred into a storage tank.

4.3 Production of the Mineral Oil Composition

The additive solution according to 4.2 is injected at 0.28 kg/min into a product stream of heating oil without additives, batch 030218, flowing at 800 kg/min, and the mixture is transferred into a storage tank.

Testing the mineral oil formulation for low-temperature resistance revealed a CFPP value of −15° C.

If a mineral oil formulation containing only the ungrafted copolymer wax as an additive is produced under the same conditions, the CFPP value is −1° C.

Example 5

5.1 Starting Materials 5.1.1 Diesel without Additives

Batch: 16080601 test DF 1

Characterization:

Cloud point (CP): +6° C.;

Cold filter plugging point (CFPP): +2° C.

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 189 | 243 | 259 | 271 | 281 | 292 | 303 | 317 | 334 | 357 | 385 |

5.1.2 Additive Component a)

60 mass % of an ethylene-vinylacetate copolymer wax grafted with vinyl acetate (produced according to DD 293 125 A5, total vinylacetate content 45 mass %, molecular mass weight average 3800 g/mol, vinylacetate content of an ungrafted ethylene-vinylacetate copolymer wax 32 mass %) and 40 mass % of an ungrafted ethylene-vinylacetate copolymer wax (manufactured by LEUNA Polymer GmbH, vinylacetate content 30.1 mass %, molecular mass number average 1920 g/mol) are intermixed.

5.1.3 Additive Component b)

Mixture of $C_3$-oxyalkyl-bridged unsaturated $C_{18}$-$C_{24}$-carboxylic acids, degree of esterification 92 mol %, content of $C_{18}$-unsaturated fatty acids 32 mass %, content of $C_{22}$-unsaturated fatty acids 48 mass %, iodine number 96

5.1.4 Additive Component c)

Styrene-maleic anhydride copolymer, partially imidated with $C_{16}$-$C_{18}$-fatty amine, molecular mass number average 26500 g/mol, acid number 8.2

5.1.5 Other Additive Components

Octadecylacrylate-ethylacrylate copolymer (mole ratio 4:1, molecular mass number average 13500)

5.2 Production of Solutions Containing the Additive Components in Mineral Oil Middle Distillates 10 kg of a 40% solution of additive component c) in $C_8$-$C_9$-diesel aromatic fraction, 20 kg of a 50% solution of additive component a) in an aromatic hydrocarbon mixture, 10 kg of additive component b), and 8 kg of a 20% solution of another additive component, octadecylacrylate-ethylacrylate copolymer in toluene, are intermixed in a stirred tank reactor for 90 minutes at 65° C., and the mixture is transferred into a storage tank.

5.3 Production of the Mineral Oil Formulation

The additive solution according to 5.2 is injected at 0.48 kg/min into a product stream of diesel without additives, batch 16080601, flowing at 800 kg/min and the mixture is transferred into a storage tank.

Testing the mineral oil formulation for low-temperature resistance revealed a CFPP value of −17° C. The CP value of the short-time sedimentation test is +6° C. The SEDAB filtration test is deemed passed (500 ml in 75 s).

If a mineral oil formulation containing only the ungrafted copolymer wax as an additive is produced under the same conditions, the CFPP value is −3° C. The CP value of the short-time sedimentation test is +10° C. The SEDAB filtration test is deemed failed (468 ml in >120 s).

Example 6

6.1 Starting Materials 6.1.1 Diesel without Additives

Batch: 030210 test DF 2

Characterization:

Cloud point (CP): +7° C.;

Cold filter plugging point (CFPP): +2° C.

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 235 | 266 | 279 | 291 | 301 | 310 | 320 | 337 | 342 | 357 | 374 |

6.1.2 Additive Component a)

50 mass % of a partially saponified ethylene-vinylacetate copolymer wax (molecular mass weight average 1650 g/mol, vinylacetate content of the unsaponified ethylene-vinylacetate copolymer wax 32 mass %, degree of saponifi-cation 15 mol %) and 50 mass % of an unsaponified ethylene-vinylacetate copolymer wax (manufactured by LEUNA Polymer GmbH, vinylacetate content 32 mass %, molecular mass number average 2015 g/mol) are intermixed.

6.1.3 Additive Component c)

Octadecene-maleic anhydride copolymer, partially imidated with $C_{16}$-$C_{18}$-fatty amine, molecular mass number average 4200 g/mol, 6.1.4 Other Additive Components Triesters of pentaerythrite with stearic acid
Dipropyleneglycol monopropyl ether 6.2 Production of Solutions Containing the Additive Components in Mineral Oil Middle Distillates 10 kg of a 40% solution of additive component c) in $C_8$-$C_9$-diesel aromatic fraction, 20 kg of a 60% solution of additive component a) in $C_8$-$C_9$-diesel aromatic fraction, 10 kg of another additive component, triesters of pentaerythrite with stearic acid, and 1 kg of yet another additive component, dipropyleneglycol monopropyl ether, are intermixed in a stirred tank reactor for 90 minutes at 65° C., and the mixture is transferred into a storage tank.

6.3 Production of the Mineral Oil Formulation

The additive solution according to 6.2 is injected at 0.24 kg/min into a product stream of diesel without additives, batch 030210, flowing at 800 kg/min and the mixture is transferred into a storage tank.

Testing the mineral oil formulation for low-temperature resistance revealed a CFPP value of −7° C. The CP value of the short-time sedimentation test is +8° C. The SEDAB filtration test is deemed passed (500 ml in 82 s).

If a mineral oil formulation containing only the unsaponified copolymer wax as an additive is produced under the same conditions, the CFPP value is −5° C. The CP value of the short-time sedimentation test is +12° C. The SEDAB filtration test is deemed failed (468 ml in >120 s).

Example 7

7.1 Starting Materials 7.1.1 Heating Oil without Additives

Batch: 030225 test HEL 1

Characterization:

Cloud point (CP): +1° C.;

Cold filter plugging point (CFPP): −1° C.

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 165 | 196 | 213 | 230 | 249 | 269 | 290 | 310 | 327 | 344 | 363 |

7.1.2 Additive Component a)

40 mass % of an oxidized ethylene-vinylacetate copolymer wax (molecular mass number average 950 g/mol, acid number 18 mg KOH/g, OH number 70 mg KOH/g) and 60 mass % of an unoxidized ethylene-vinylacetate copolymer wax (manufactured by LEUNA Polymer GmbH, vinylacetate content 32 mass %, molecular mass weight average 4400 g/mol) are intermixed.

7.1.3 Additive Component b)

Diester of Propylene Glycol with Oleic Acid 7.1.4 Additive Component c)

α-Methylstyrene-maleic anhydride copolymer, partially imidated with oleylamine, molecular mass number average 16500 g/mol, acid number 15

7.2 Production of Solutions Containing the Additive Components in Mineral Oil Middle Distillates 25 kg of a 40% solution of additive component c) in $C_8$-$C_9$-diesel aromatic fraction, 50 kg of a 60% solution of additive component a) in $C_8$-$C_9$-diesel aromatic fraction, 25 kg of additive component b) are intermixed in a stirred tank reactor for 90 minutes at 65° C., and the mixture is transferred into a storage tank.

7.3 Production of the Mineral Oil Formulation

The additive solution according to 7.2 is injected at 0.24 kg/min into a product stream of diesel oil without additives, batch 030225, flowing at 800 kg/min, and the mixture is transferred into a storage tank.

Testing the mineral oil formulation for low-temperature resistance revealed a CFPP value of −15° C.

If a mineral oil formulation containing only the unsaponified copolymer wax as an additive is produced under the same conditions, the CFPP value is −13° C.

Example 8

8.1 Starting Materials 8.1.1 Diesel without Additives

Batch: 16080601 test DF 1

Characterization:

Cloud point (CP): +6° C.;

Cold filter plugging point (CFPP): +2° C.

Distillation Analysis:

Distilled quantity (vol. %)/temperature (° C.)

| IBP | 10 | 20 | 30 | 40 | 50 | 60 | 70 | 80 | 90 | FBP |
|---|---|---|---|---|---|---|---|---|---|---|
| 189 | 243 | 259 | 271 | 281 | 292 | 303 | 317 | 334 | 357 | 385 |

8.1.2 Additive Component a)

40 mass % of an ethylene-vinylacetate copolymer wax grafted with vinyl acetate (produced according to DD 293 125 A5, total vinylacetate content 38 mass %, molecular mass weight average 3900 g/mol, vinylacetate content of the ungrafted ethylene-vinylacetate copolymer wax 32 mass %) and 60 mass % of an ungrafted ethylene-vinylacetate copolymer wax (manufactured by LEUNA Polymer GmbH, vinylacetate content 33 mass %, molecular mass weight average 2300 g/mol) are intermixed.

8.1.3 Additive Component c)

α-Methylstyrene-maleic anhydride copolymer, partially imidized with $C_{12}$-$C_{14}$-fatty amine, molecular mass number average 11000 g/mol, acid number 25

8.1.4 Other Additive Components

Pentaethylenehexamine-1,2-diaminobutanol
Polypropyleneglycol, molar mass 1500

8.2 Production of Solutions Containing the Additive Components in Mineral Oil Middle Distillates 25 kg of a 40% solution of additive component c) in $C_8$-$C_9$-diesel aromatic fraction, 50 kg of a 50% solution of additive component a) in an aromatic hydrocarbon mixture, 4 kg of another additive component, pentaethylene hexamine-1,2-diaminobutanol, and 3 kg of yet another additive component, polypropyleneglycol, molar mass 1500, are introduced into a stirred tank reactor, stirred for 90 minutes at 65° C., and the mixture is transferred into a storage tank.

8.3 Production of the Mineral Oil Formulation

The additive solution according to 8.2 is injected at 0.48 kg/min into a product stream of diesel without additives, batch 16080601, flowing at 800 kg/min and the mixture is transferred into a storage tank.

Testing the mineral oil formulation for low-temperature resistance revealed a CFPP value of −13° C.

If a mineral oil formulation containing only the ungrafted copolymer wax as an additive is produced under the same conditions, the CFPP value is −3° C.

The invention claimed is:

1. A composition of mineral oil as the main component and an additive mixture wherein the additive mixture contains the additive components a) mixtures of 40.00 to 60.00 mass % of ethylene-vinylester copolymers modified by polar groups with molecular mass weight averages of 3000 to 50000 and an ethylene portion of 50 to 90 mass % and 60.00 to 40.00 mass % of unmodified ethylene-vinylester copolymers, in which the ethylene-vinylester copolymers modified by polar groups are a1) hemiacetals of ethylene-vinylester-vinylalcohol copolymers with butyraldehyde and/or a2) ethylene-vinylacetate copolymers grafted with vinylacetate and having molecular mass number averages from 800 to 5000 and a total vinylacetate content of 20 to 60 mass %, the vinylacetate content of the copolymer backbone chain being from 10 to 40 mass % and the portion of the grafted vinylacetate branches in relation to the vinylacetate-grafted ethylene-vinylacetate copolymers making up 10 to 20 mass %, and contain b) esters of $C_2$-$C_6$-polyalcohols and $C_{12}$-$C_{40}$-monocarboxylic acids, and/or c) partially and/or completely imidated copolymers of unsaturated $C_a$-$C_{20}$-dicarboxylic anhydrides and vinyl aromatics and/or $C_2$-$C_{36}$-α-olefin, whereby the content of the additive mixture in the mineral oil is 0.005 to 1 mass % and the mass ratio of the additive components a/b or a/c or a/(b+c) is 10:90 to 90:10, respectively.

2. The composition according to claim 1 wherein the esters of $C_2$-$C_6$ polyalcohols and $C_{12}$-$C_{40}$-monocarboxylic acids are esters of unsaturated $C_{16}$-$C_{24}$-monocarboxylic acids having a $C_{22}$-monocarboxylic acid content in relation to the overall mass of the $C_{16}$-$C_{24}$-monocarboxylic acids of 45 to 52 mass % with $C_3$-$C_4$-polyalcohols.

3. The composition according to claim 1 wherein the partially imidated copolymers of unsaturated dicarboxylic anhydrides and vinyl aromatics are maleic anhydride-α-methylstyrene copolymers partially imidated with $C_6$-$C_{24}$ monoalkylamines in which the mole ratio of anhydride groups in the copolymer/bound $C_6$-$C_{24}$ monoalkylamine in the copolymer is 8:1 to 1.3:1.

4. A composition of mineral oil according to claim 1 wherein the mineral oils are crude oils or fuel oils from a middle distillate with a sulfur content under 0.05 mass %, preferably heating oils, gas oils, or diesel oils.

5. The composition of mineral oil according to claim 1 wherein the mineral oil contains a total of 0 to 200 mass % in relation to the total of additive components a) and b) or a) and c) or a), b), and c) of other additive components such as fatty acid mixtures, polar nitrogen compounds, preferably polyamines, etheramines, amino alcohols, amine salts, amides or imides of multivalent carboxylic acids; $C_7$-$C_{30}$-alcohols, polyalkylene glycols, esters or ethers of polyoxyalkylene compounds, unmodified ethylene-vinylester copolymers, hydrocarbon polymers, alkylphenol-aldehyde copolymers, aromatic compounds with $C_8$-$C_{100}$-alkyl substituents, carboxylated polyamines, detergents, corrosion inhibitors, demulsifiers, metal deactivators, cetane number improvers, defoaming agents and/or cosolvents.

6. A method for producing compositions of mineral oil as the main component and an additive mixture wherein the additive mixture contains the additive components a) mixtures of 40.00 to 60.00 mass % of ethylene-vinylester copolymers modified by polar groups with molecular mass weight averages of 3000 to 50000 and an ethylene portion of 50 to 90 mass % and 60.00 to 40.00 mass % of unmodified ethylene-vinylester copolymers, in which the ethylene-vinylester copolymers modified by polar groups are a1) hemiacetals of ethylene-vinylester-vinylalcohol copolymers with butyraldehyde and/or a2) ethylene-vinylacetate copolymers grafted with vinylacetate and having molecular mass number averages from 800 to 5000 and a total vinylacetate content of 20 to 60 mass %, the vinylacetate content of the copolymer backbone chain being from 10 to 40 mass % and the portion of the grafted vinylacetate branches in relation to the vinylacetate-grafted ethylene-vinylacetate copolymers making up 10 to 20 mass %, and contain b) esters of $C_2$-$C_6$-polyalcohols and $C_{12}$-$C_{40}$-monocarboxylic acids, and/or c) partially and/or completely imidated copolymers of unsaturated $C_4$-$C_{20}$-dicarboxylic acid anhydrides and vinyl aromatics and/or $C_2$-$C_{36}$-α-olefin, whereby the content of the additive mixture in the mineral oil is 005 to 1 mass % and the mass ratio of the additive components a/b or a/c or a/(b+c) is 10:90 to 90:10, respectively, are produced in a prehomogenization process in which solutions containing 1 to 60 mass % of additive components in mineral oil middle distillates are produced at 20 to 90° C. in a first process step, and the solutions containing the additive components are homogenized with the mineral oil as the main component in a second process step, whereby a total of 0 to 200 mass % in relation to the total of additive components a) and b), or a) and c), or a) and b) and c) of other additive components are added to the mineral oil in the first and/or second process step.

* * * * *

UNITED STATES PATENT AND TRADEMARK OFFICE

CERTIFICATE OF CORRECTION

PATENT NO. : 7,776,801 B2
APPLICATION NO. : 10/577006
DATED : August 17, 2010
INVENTOR(S) : Hiltrud Täubert et al.

It is certified that error appears in the above-identified patent and that said Letters Patent is hereby corrected as shown below:

Claim 6, sub-section c), in columns 19-20, should read as follows:

c) partially and/or completely imidated copolymers of unsaturated C4-C20-dicarboxylic acid anhydrides and vinyl aromatics and/or C2-C36-α-olefin, whereby the content of the additive mixture in the mineral oil is 0.005 to 1 mass % and the mass ratio of the additive components a/b or a/c or a/(b+c) is 10 : 90 to 90 : 10, respectively, are produced in a prehomogenization process in which

- solutions containing 1 to 60 mass % of additive components in mineral oil middle distillates are produced at 20 to 90°C in a first process step, and

- the solutions containing the additive components are homogenized with the mineral oil as the main component in a second process step, whereby a total of 0 to 200 mass % in relation to the total of additive components a) and b), or a) and c), or a) and b) and c) of other additive components are added to the mineral oil in the first and/or second process step.

Signed and Sealed this

Thirtieth Day of November, 2010

David J. Kappos

David J. Kappos
*Director of the United States Patent and Trademark Office*